US006115055A

United States Patent [19]

Kashiwaya et al.

[11] Patent Number: 6,115,055

[45] Date of Patent: Sep. 5, 2000

[54] THERMAL HEAD

[75] Inventors: Makoto Kashiwaya, Kanagawa; Junichi Yoneda, Shizuoka, both of Japan

[73] Assignee: Fuji Photo Film Co., Ltd., Kanagawa, Japan

[21] Appl. No.: 09/282,447

[22] Filed: Mar. 31, 1999

[30] Foreign Application Priority Data

Mar. 31, 1998 [JP] Japan ..... 10-085866

[51] Int. Cl.[7] ..... B41J 2/335

[52] U.S. Cl. ..... 347/203

[58] Field of Search ..... 347/203

[56] References Cited

FOREIGN PATENT DOCUMENTS

| | | | |
|---|---|---|---|
| 0 891 868 | 1/1999 | European Pat. Off. . | |
| 61-53955 | 11/1986 | Japan | B41J 3/20 |
| 4-62866 | 10/1992 | Japan | B41J 2/335 |
| 7-132628 | 5/1995 | Japan | B41J 2/335 |

OTHER PUBLICATIONS

Patent Abstracts of Japan, vol. 018, No. 033 1/30/87, & JP 61 201479 (Teijin Ltd) 9/6/86 *Abstract.

Patent Abstracts of Japan, vol. 018, No. 264, 5/19/94 & JP 06 036210 A (Alps Electric Co Ltd) 2/1098 *Abstract.

Patent Abstracts of Japan, vol. 1998, No. 06 4/30/98 & JP 10 034989 A (Rohm Co Ltd), 2/10/98 *Abstract.

Patent Abstracts of Japan, vol. 012, No. 475, 12/1388, & JP 63 197665 A (Alps Electric Co Ltd). 8/1698 *Abstract.

*Primary Examiner*—Huan Tran

*Attorney, Agent, or Firm*—Sughrue, Mion, Zinn, Macpeak & Seas, PLLC

[57] ABSTRACT

The thermal head having a protective film of a heating element, the protective film comprising at least one protective layer including a carbon-based carbon protective layer, wherein an oxygen amount in an interface between the carbon protective layer and a lower layer formed under the carbon protective layer is not more than 20 atm %. The thermal head includes a protective film which has significantly reduced corrosion and wear, which is free from cracking and peeling due to heat and mechanical impact and which allows the thermal head to have sufficient durability to ensure that the thermal recording of high-quality images is consistently performed over an extended period of time. Even for an application in which recording under high-energy and high-pressure conditions is performed on a thermal film using a high rigid substrate to be employed in the medical use and the like, the thermal head also has sufficient durability to exhibit high reliability over an extended period of time.

5 Claims, 3 Drawing Sheets

THERMAL HEAD

BACKGROUND OF THE INVENTION

This invention relates to the art of thermal heads for thermal recording which are used in various types of printers, plotters, facsimile, recorders and the like as recording means.

Thermal materials comprising a thermal recording layer on a substrate of a film or the like are commonly used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising heat-generating resistors and electrodes, used for heating the thermal recording layer of a thermal material to record an image, are arranged in one direction (main scanning direction) and, with the glaze urged at small pressure against the thermal material (thermal recording layer), the two members are moved relative to each other in the auxiliary scanning direction perpendicular to the main scanning direction, and energy is applied to the heating elements of the respective pixels in the glaze in accordance with image data to be recorded which were supplied from an image data supply source such as MRI in order to heat the thermal recording layer of the thermal material, thereby accomplishing image reproduction.

A protective film is formed on the surface of the glaze of the thermal head in order to protect the heating elements and the like for heating a thermal material. Therefore, it is this protective film that contacts the thermal material during thermal recording and the heating elements heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density unevenness will occur on the thermal image or a desired protective strength can not be maintained and, hence, the ability of the film to protect the heating elements is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head and improving its durability, a number of techniques to improve the performance of the protective film have been considered. Among others, a carbon protective film with carbon as a main component, that is, a carbon-based protective film (hereinafter referred to as a carbon protective layer) is known as a protective film excellent in resistance to wear and corrosion.

Thus, Examined Published Japanese Patent Applications (KOKOKU) No. 61-53955 and No. 4-62866 (the latter being the divisional application of the former) disclose a thermal head excellent in wear resistance and response which is obtained by forming a very thin carbon protective layer having a Vickers hardness of 4500 kg/mm$^2$ or more as the protective film of the thermal head and a method of manufacturing the thermal head, respectively. The carbon protective layer has properties quite similar to those of diamond including a very high hardness and chemical stability, hence the carbon protective layer presents sufficiently excellent properties to prevent wear and corrosion which may be caused by the sliding contact with thermal materials.

The carbon protective layer is excellent in wear resistance, but brittle because of its hardness, that is, low in tenacity and rather inferior adhesion to a lower layer so that heat shock and thermal stress due to heating of heating elements may bring about rather easily cracking or peeling.

In order to solve the problem, Unexamined Published Japanese Patent Application (KOKAI) No. 7-132628 discloses a thermal head which has a dual protective film comprising a lower protective layer composed of a silicon-based compound and an upper carbon protective layer (diamond-like carbon layer), whereby the potential wear and breakage of the protective film due to heat chock and the like are significantly reduced with the help of enhanced adhesion of the carbon protective layer to ensure that high-quality images can be recorded over an extended period of time. In this document, another technique is disclosed that enhances the adhesion between the carbon protective layer and the lower protective layer by processing the surface of the lower protective layer employing a plasma-assisted CVD (chemical vapor deposition) in a reducing atmosphere.

However, the adhesion of the carbon protective layer is not enough and, especially, in the medical applications as described above, the carbon protective layer is liable to be cracked or peeled off by a stress due to a difference in coefficient of thermal expansion between the respective layers, a mechanical impact due to a foreign matter entered between the thermal material and the thermal head (glaze) during recording operation or other factors.

Cracking or peeling in the protective layer gives rise to wear, corrosion and wear due to corrosion, which results in reduction of the durability of the thermal head. The thermal head is not capable of exhibiting high reliability over an extended period of time.

SUMMARY OF THE INVENTION

The present invention has been accomplished under these circumstances and has as an object providing a thermal head having a carbon-based protective layer (carbon protective layer) which is significantly protected from corrosion and wear as well as cracking and peeling due to heat and mechanical impact by retaining enough adhesion between the carbon protective layer and the lower layer, and which allows the thermal head to have sufficient durability to ensure that the thermal recording of high-quality images is consistently performed over an extended period of time.

In order to achieve the above object, the invention provides a thermal head having a protective film of a heating element, said protective film comprising at least one protective layer including a carbon protective layer with carbon as a main component, in which an oxygen amount in an interface between said carbon protective layer and a lower layer formed under said carbon protective layer is not more than 20 atm %.

It is preferred that said at least one protective film further comprises an intermediate protective layer formed as said lower layer under said carbon protective layer and a ceramic-based lower protective layer formed under said intermediate protective layer.

It is further preferred that said intermediate protective layer is based on at least one component selected from the group consisting of metals of Groups IVA, VA and VIA, and Si and Ge.

It is further preferred that said at least one protective layer further comprises a ceramic-based lower protective layer formed as said lower layer under said carbon protective layer.

It is further preferred that said oxygen in the interface is not more than 10 atm %.

DETAILED DESCRIPTION OF THE INVENTION

The thermal head of the invention will now be described in detail with reference to the preferred embodiments shown in the accompanying drawings.

Figure 1:
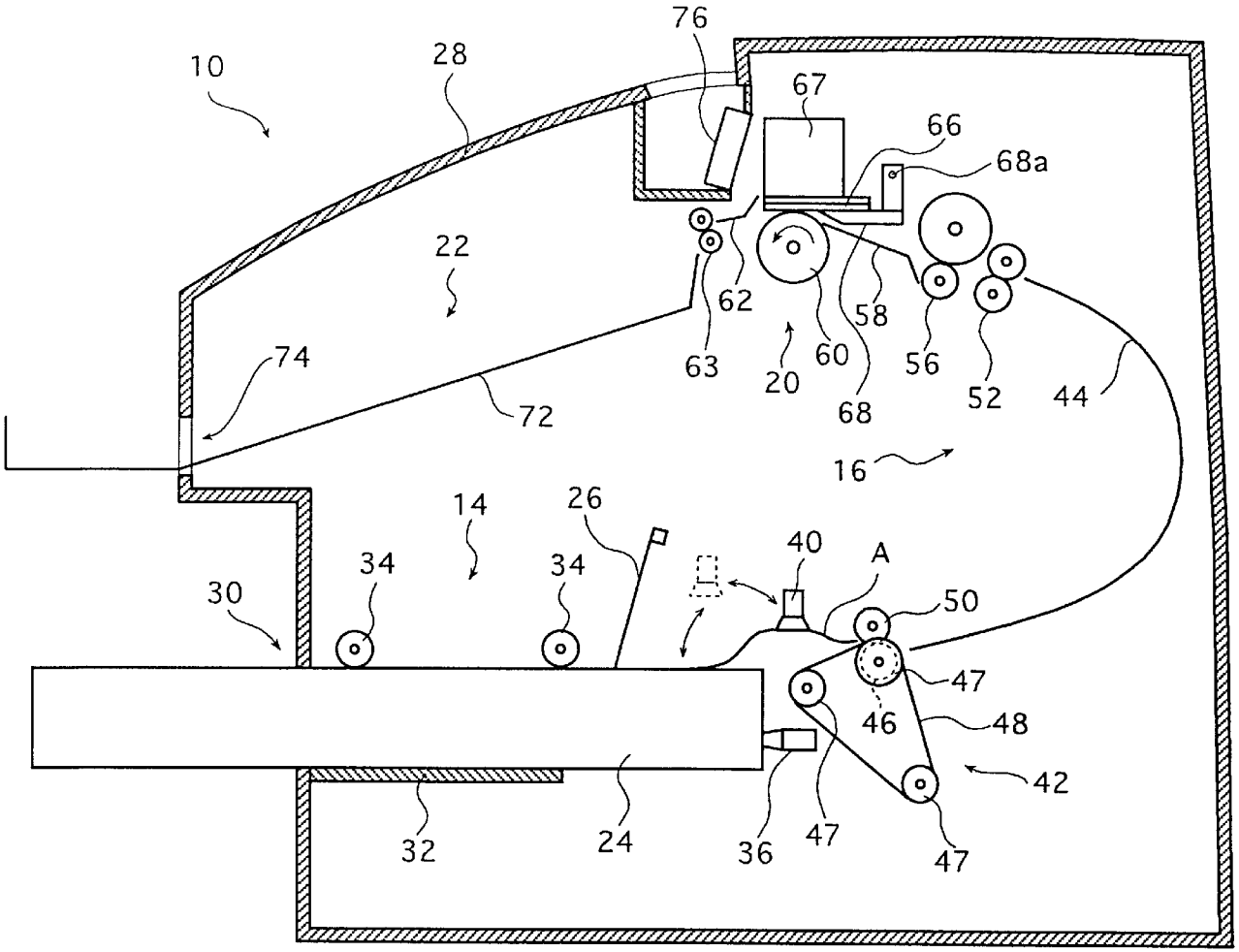
FIG. 1 shows the concept of an exemplary thermal recording apparatus using the thermal head of the invention.

FIG. 1 shows schematically an exemplary thermal recording apparatus using the thermal head of the invention.

The thermal recording apparatus 10 shown in FIG. 1 (hereinafter simply referred to as the "recording apparatus") performs thermal recording on thermal materials of a given size, say, B4 or 257 mm×364 mm (namely, thermal materials in the form of cut sheets, which are hereinafter referred to as "thermal materials A"). The apparatus comprises a loading section 14 where a magazine 24 containing thermal materials A is loaded, a feed/transport section 16, a recording section 20 performing thermal recording on thermal materials A by means of a thermal head 66, and an ejecting section 22.

The thermal material A is a conventional thermal material that includes a substrate of a transparent polyethylene terephthalate (PET) film or the like a surface of which are overlaid with a thermal recording layer.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30; thereafter, the magazine 24 is loaded at a specified position in the recording apparatus 10 as it is guided by the guide plate 32 and the guide rolls 34 and the stop member 36.

The feed/transport section 16 has the sheet feeding mechanism using a sucker 40 for grabbing the thermal material A, a transport means 42, a transport guide 44 and a regulating roller pair 52; thermal materials A are taken one by one out of the magazine 24 in the loading section 14 and transported to the recording section 20.

The transport means 42 comprises a transport roller 46, three pulleys 47 including a pulley coaxial with the transport roller 46, an endless belt 48 stretched between the pulleys, and a nip roller 50 that pairs with the transport roller 46. The forward end of the thermal material A which has been sheet-fed by means of the sucker 40 is pinched between the transport roller 46 and the nip roller 50 such that the material A is transported.

The thermal material A is supplied into the regulating roller pair 52 by the transport means 42 as it is guided by the transport guide 44; the forward end of the thermal material A reaches the regulating roller pair 52 and is subjected to positioning by means of the regulating roller pair 52; after it is confirmed that the thermal head 66 has reached a specified temperature, the thermal material A is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of image recording on thermal sheets of up to, for example, B4 size at a recording (pixel) density of, say, about 300 dpi. Except for the protective film, the head 66 has a known structure in that it has the glaze in which the heating elements performing thermal recording on the thermal material A are arranged in one direction, that is, in the main scanning direction (in a direction perpendicular to paper surfaces of FIGS. 1 and 2), and is supported on a support member 68.

It should be noted that the thermal head 66 of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

Figure 2:
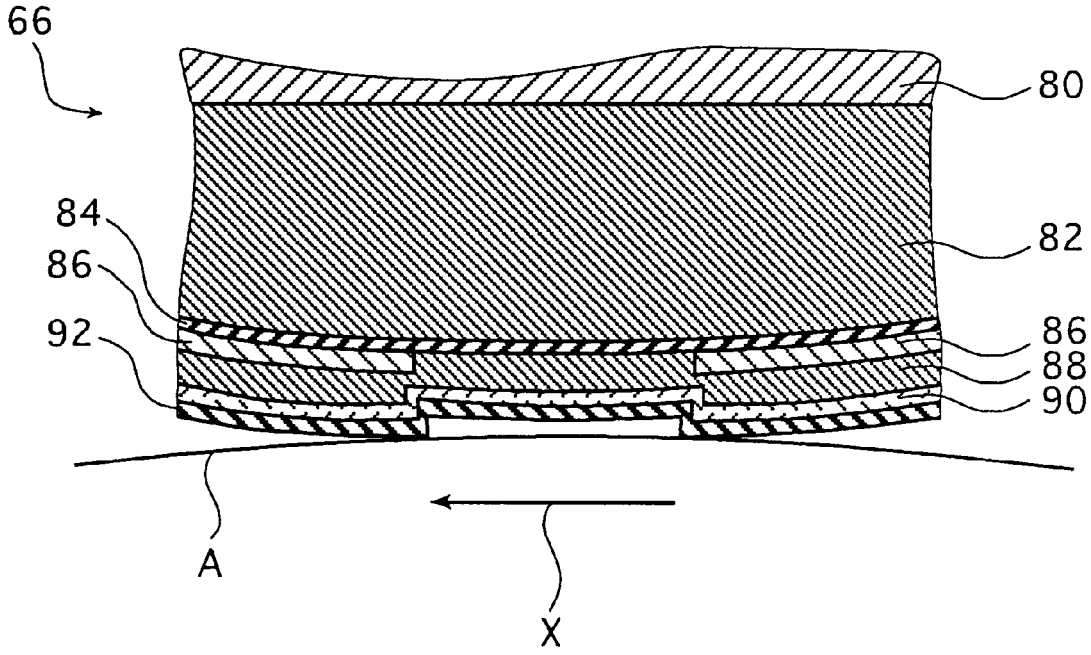
FIG. 2 is a schematic cross sectional view showing the structure of a heating element in the thermal head of the invention.

The platen roller 60 rotates at a specified image recording speed in the direction shown by the arrow in FIG. 1 while holding the thermal material A in a specified position and transports the thermal material A in the auxiliary scanning direction which is perpendicular to the main scanning direction and is shown by the arrow X in FIG. 2.

The cleaning roller pair 56 has an adhesive rubber roller made of an elastic material shown in an upper side in FIG. 1 and picks up dirt and other foreign matter that have been deposited on the thermal recording layer of the thermal material A, thereby preventing the dirt from being deposited on the glaze or otherwise adversely affecting the image recording operation.

In such the recording apparatus 10 a sheet of the thermal material A is drawn out of the magazine 24, and transported up to the recording section 20. Thereafter, in the recording section 20, the thermal material A is further transported in the auxiliary scanning direction while the glaze of the thermal head 66 is pressed onto the thermal material A so as to allow respective heating elements formed on the glaze of the thermal head 66 to generate heat in correspondence with the recorded image (image data), whereupon thermal recording on the thermal material A is performed.

After the end of thermal recording, the thermal material A on which the image is recorded as it is guided by the guide 62 is transported by the platen roller 60 and the transport roller pair 63 to be ejected into a tray 72 in the ejecting section 22.

FIG. 2 is a schematic cross section of the glaze of the thermal head 66.

The glaze is constructed with a glaze layer 82 (heat accumulating layer) formed on the top of a substrate 80 (which is shown to face down in FIG. 2 since the thermal head 66 is pressed downward against the thermal material A), a heater (heat generater, i.e. heat-generating resistor) 84 formed on the glaze layer 82, electrodes 86 formed on the heater 84 and a protective film which protects the heating elements and the like having the heater 84 and the electrodes 86.

The illustrated protective film of the glaze of the thermal head 66 is composed of three layers: a lower protective layer 88 superposed on the heater 84 and the electrodes 86, an intermediate protective layer 90 (hereinafter called as "intermediate layer 90") formed on the lower protective layer 88 and a carbon-based protective layer, that is, a carbon protective layer 92 (diamond-like carbon (DLC) protective layer) which is formed on the intermediate layer 90.

The thermal head 66 of the invention has essentially the same structure as known versions of thermal head except for the protective film. Therefore, the arrangement of other layers and the constituent materials of the respective layers are not limited in any particular way and various known versions may be employed. Specifically, the substrate 80 may be formed of various electrical insulating materials including heat-resistant glass and ceramics such as alumina, silica and magnesia; the glaze layer 82 may be formed of heat-resistant glass, heat resistant resins including polyimide resin and the like; the heater 84 may be formed of heat-generating resistors such as Nichrome (Ni—Cr), tantalum metal and tantalum nitride; and the electrodes 86 may be formed of electrically conductive materials such as aluminum and copper.

Heating elements on the glaze are known to be available usually in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

The material of the lower protective layer 88 to be formed on the thermal head 66 of the invention is not limited in any particular way as long as they have sufficient heat resistance, corrosion resistance and wear resistance to serve as the protective film of the thermal head and the lower protective layer 88 may be formed of a variety of known materials, preferably, for example, a variety of ceramic-based materials.

Specific materials include silicon nitride ($Si_3N_4$), silicon carbide (SiC), tantalum oxide ($Ta_2O_5$), aluminum oxide ($Al_2O_3$), SIALON (Si—Al—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among others, nitrides and carbides are preferably used in various aspects such as easy film deposition, reasonability in manufacturing including manufacturing cost, balance between mechanical wear and chemical wear. Silicon nitride, silicon carbide and SIALON are more preferably used. Additives such as metals to may be incorporated in small amounts into the lower protective layer 88 to adjust physical properties thereof.

Methods of forming the lower protective layer 88 are not limited in any particular way and known methods of forming ceramic films (layers) may be employed to form the lower protective layer 88 by applying the aforementioned thick-film and thin-film processes and the like.

The thickness of the lower protective layer 88 is not limited to any particular value but it ranges preferably from about 0.2 $\mu$pm to about 20 $\mu$m, more preferably from about 2 $\mu$m to about 15 $\mu$m. If the thickness of the lower protective layer 88 is within the stated ranges, preferred results are obtained in various aspects such as the balance between wear resistance and heat conductivity (that is, recording sensitivity).

The lower protective layer 88 may comprise multiple sub-layers. In this case, multiple sub-layers may be formed of different materials or multiple sub-layers different in density may be formed of one material. Alternatively, the two methods may be combined to obtain sub-layers.

The illustrated thermal head 66 has, as a preferred embodiment, a three-layered protective film composed of such the lower protective layer, the intermediate layer 90 deposited on the lower protective layer 88 and the carbon-based protective layer 92 deposited on the intermediate layer.

Since the carbon protective layer 92 has very high chemical stability as described above, the carbon protective layer 92 formed on the lower protective layer 88 can effectively protect the lower protective layer 88, heat-generating resistor 84 and electrodes 86 and the like from chemical corrosion, thereby prolonging the service life of the thermal head 66 and, moreover, the intermediate layer 90 enhances adhesion between the lower protective layer 88 and the carbon-based protective layer 92 and shock absorption, whereupon the thermal head having sufficient durability, high reliability and excellent serviceability over an extended period of time can be realized.

The intermediate layer 90 formed on the thermal head 66 is preferably based on at least one component selected from the group consisting of metals in Group IVA (titanium group), Group VA (vanadium group) and Group VIA (chromium group) of the periodic table, as well as silicon (Si) and germanium (Ge) in such aspects as the adhesion between the upper carbon protective layer 92 and the lower protective layer 88 and the durability of the carbon protective layer 92.

Preferred specific examples include Si, Ge, titanium (Ti), tantalum (Ta), molybdenum (Mo) and mixtures thereof. Among others, Si and Mo are more preferably used in the binding with carbon and other aspects. Most preferably, Si is used.

Methods of forming the intermediate layer 90 are not limited in any particular way and any known film deposition methods may be used in accordance with the material of the intermediate layer 90 by applying the aforementioned thick-film and thin-film processes and the like. A preferred method includes sputtering, but plasma-assisted CVD is also available with advantage.

The intermediate layer 90 may also comprise multiple sub-layers. In this case, multiple sub-layers may be formed of different materials or multiple sub-layers different in density may be formed of one material. Alternatively, the two methods may be combined to obtain sub-layers.

Prior to forming the intermediate layer 90, lapping treatment, etching treatment and the like are preferably performed to appropriately roughen the surface of the lower protective layer. Thus, the adhesion between the lower protective layer 88 and the intermediate layer 90 and the adhesion between the intermediate layer 90 and the carbon protective layer 92 can be further improved, whereupon the thermal head can have more improved durability.

In this case, roughness of the surface of the lower protective layer 88 is not limited in any particular value and Ra value (center line average height) of the roughness of the surface is preferably between 0.005 μm and 0.5 μm.

In the illustrated thermal head 66, the carbon protective layer 92 that has carbon as a main component is formed on the intermediate layer 90. As described above, since the carbon protective layer 92 is chemically very stable, the carbon protective layer 92 effectively prevents chemical corrosion of the lower protective layer 88 and preferably enhances durability of the thermal head. The carbon-based protective layer 92 of the invention refers to a carbon film that contains more than 50 atm % of carbon and preferably comprises carbon and inevitable impurities.

In the thermal head according to the invention, the components to be incorporated in addition to carbon to form the carbon protective layer 92 include advantageously elements such as hydrogen, nitrogen and fluorine. In the case of hydrogen, nitrogen and fluorine, the content thereof in the carbon protective layer 92 is preferably less than 50 atm %, whereas in the case of the above-mentioned Si and Ti, the content thereof is preferably not more than 20 atm %.

The hardness of the carbon protective layer 92 is not limited to any particular value as far as the carbon protective layer 92 has a sufficient hardness to serve as the protective film of the thermal head. Thus, the carbon protective layer 92 having a Vickers hardness of from 3000 $kg/mm^2$ to 5000 $kg/mm^2$ is advantageously illustrated. The hardness may be constant or varied in the thickness direction of the carbon protective layer 92. In the latter case, the hardness variation may be continuous or stepwise.

Methods of forming the carbon protective layer 92 are not limited in any particular way and known film forming (or film deposition) processes may be employed. Preferred examples include the plasma-assisted CVD using a hydrocarbon gas as a reactive gas to form a hard carbon film and the sputtering of a carbonaceous material (e.g., sintered carbon or glassy carbon) as a target to form a hard carbon film.

The carbon protective layer 92 may be formed with heating to between about 50° C. and about 400° C. and especially to the temperature in which the thermal head 66 is used. In this method, the adhesion between the carbon protective layer 92 and the intermediate layer 90 and also between the intermediate layer 90 and the lower protective layer 88 can further be improved, and excellent durability can be imparted to the carbon protective layer 92 which is protected from cracking and peeling caused by a heat shock and a mechanical impact due to a foreign matter entered between the thermal material and the thermal head during the thermal recording, as well as from deterioration of properties and wear-away of the carbon layer due to high power recording. Heating may be performed by a heating means such as a heater or the like or energizing the thermal head 66.

The intermediate layer 90 and the carbon protective layer 92 in the thermal head 66 with a structure of three protective layers are not limited in their thickness to any particular values. The intermediate protective layer 90 has preferably a thickness of from 0.05 μm to 2 μm, more preferably from 0.1 μm to 1 μm. The carbon protective layer 92 has preferably a thickness of from 0.5 μm to 5 μm, more preferably from 1 μm to 3 μm.

In the case of the intermediate layer 90 which is much thicker than the carbon protective layer 92, cracking and peeling may often take place in the intermediate layer 90. When the intermediate layer 90 is much thinner than the carbon protective layer 92, the intermediate layer 90 does not fully execute its desired function. On the other hand, if the thickness of the intermediate protective layer 90 and the carbon protective layer 92 are within the above ranges, the adhesion of the intermediate layer 90 to the lower protective layer 88 and the shock absorption thereof as well as the functions such as durability and the like of the carbon protective layer 92 can be realized in a constant and well balanced manner.

The protective film formed in the thermal head of the invention is not limited to such three-layered structure and a variety of structures are available as far as the protective film includes the carbon protective layer 92, and the oxygen amount in the area between the aforementioned carbon protective layer and the lower layer, which will be described later, is not more than 20 atm %.

For example, a two-layered protective film that forms the carbon protective layer 92 directly on the lower protective layer 88 without comprising the intermediate layer 90 is applicable. As another example, the protective film may have a one-layer structure that forms the carbon protective layer 92 directly on the heater 84 and the electrodes 86 comprising neither the intermediate layer 90 nor the lower protective layer 88.

In the case of the protective film with the two-layer structure that does not include the intermediate layer 90, the thickness of the lower protective layer 88 is preferably 2 μm to 50 μm, more preferably 4 μm to 20 μm and the thickness of the carbon protective layer 92 is preferably 0.1 μm to 5 μm and more preferably 1 μm to 3 μm. In the case of the protective film with the one-layer structure that includes neither the lower protective layer 88 nor the intermediate layer 90, the thickness of the carbon protective layer 92 is preferably 1 μm to 20 μm and more preferably 2 μm to 10 μm.

By retaining the thickness of the respective protective layers of the protective film within the above ranges, a preferable result can be obtained in respect of a proper balance between wear resistance or durability and heat conductivity, and so forth.

It should be noted that the thermal head of the invention is structured in such a manner that the oxygen amount in the interface where the carbon protective layer and the lower layer face to each other is not more than 20 atm % and preferably not more than 10 atm %.

Take, for example, the case of the protective film with the three-layer structure illustrated in FIG. 2, the thermal head is structured in such a way that the oxygen amount in the interface between the intermediate layer 90 and the carbon protective layer 92 is not more than 20 atm %. On the other hand, if the protective film is composed of two layers without having the intermediate layer 90, the thermal head is structured in such a way that the oxygen amount in the interface between the lower protective layer 88 and the carbon protective layer is 20 atm %.

Since the carbon protective layer 92 is hard and chemically very stable as described above, it has a very desirable characteristic as a protective film for the thermal head. However, since it has inferior adhesion to the lower layer, it has a disadvantage in that it is liable to be peeled off or cracked.

Inventors of the invention have studied for enhancing the adhesion between the carbon protective layer 92 and the lower layer and, as the result, knew that the oxygen existing in the interface between the carbon protective layer 92 and the lower layer, or more specifically on the surface of the lower layer at the time of forming the carbon protective layer 92 gave a detrimental effect to the adhesion of the carbon protective layer 92 and that bringing the oxygen amount in the interface between the carbon protective layer 92 and the lower layer in the thermal head to be not more than 20 atm %, preferably not more than 10 atm %, enables to obtain very good adhesion between the carbon protective layer 92 and the lower layer and, as the result, to obtain the thermal head which does not cause cracking or peeling of the carbon protective layer 92 over the extended period of time, while retaining excellent durability. Especially, the protective film with a three-layer structure including the intermediate layer 90 as in the illustrated example can bring about the thermal head with excellent durability.

Methods of forming such protective film of the thermal head 66 are not limited in any particular way and, as a preferred example, a method is illustrated in which the lower layer of the carbon protective layer 92, that is, the intermediate layer 90 or the lower protective layer 88 in the above case, is formed by a vapor-phase film deposition method under reduced pressure such as spattering, plasma-assisted CVD or the like and then the carbon protective layer is formed without releasing the interior of the film deposition system to the atomosphere, that is, without introducing air (gases including oxygen) inside the chamber of the film deposition apparatus.

In these forming methods, after the intermediate layer 90 is formed, the inside of the film deposition system is pumped down to a vacuum, preferably pumped down to the vacuum up to the maximum level which the apparatus can endure and thereafter the carbon protective layer 92 is preferably formed. This step enables to reduce the oxygen amount existing in the interface between the carbon protective layer 92 and the lower layer so that the better adhesion can be obtained.

As another film deposition method, it is exemplified that, after the lower layer of the carbon protective layer 92 is formed, the surface of the lower layer is etched to remove oxides thereon and thereafter the carbon protective layer 92 is formed.

In this case, etching the lower layer is preferably applicable to the method that forms the carbon protective layer 92 after above mentioned lower layer is formed and the inside of the film deposition system is preferably pumped down to the vacuum without allowing the air to enter the inside of the system.

Figure 3:
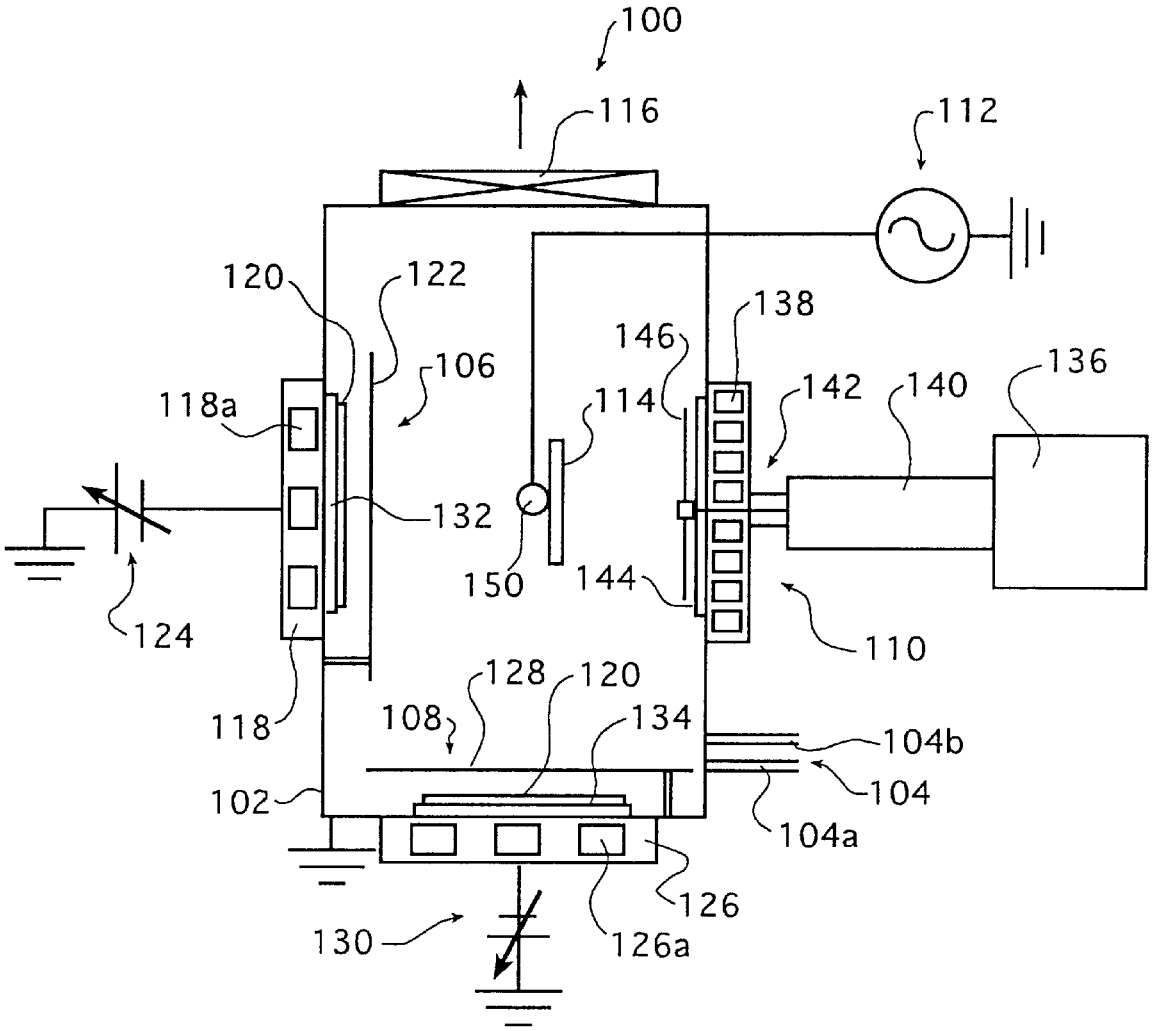
FIG. 3 shows the concept of an exemplary film deposition apparatus for use in fabricating the thermal head of the invention.

FIG. 3 shows the concept of a film deposition apparatus for fabricating the thermal head of the invention in accordance with the aforementioned fabrication method.

The illustrated film deposition apparatus 100 in FIG. 3 comprises a vacuum chamber 102, a gas introducing section 104, a first sputter means 106, a second sputter means 108, a plasma generating means 110, a bias source 112 and a substrate holder 114 as basic components.

The film deposition apparatus 100 comprises three film deposition means located in the system or the vacuum chamber 102, the two being performed by sputtering and the other by plasma-assisted CVD. The intermediate layer 90 (or the lower protective layer 88) and the carbon protective layer 92 can be successively deposited on the film deposition substrate of the thermal head 66 by sputtering using different targets or the combination of sputtering with plasma-assisted CVD, without taking the thermal head 66 out of the system and retaining the reduced pressure state without introducing the air into the system.

Therefore, a plurality of layers with different compositions can be successively deposited on the substrate by means of the film deposition apparatus 100, without releasing the inside of the system to the atomosphere, whereupon the fabrication method of the aforementioned thermal head of the invention can efficiently be performed.

The vacuum chamber 102 is preferably formed of a nonmagnetic material such as SUS 304 and the like and arranges a vacuum pump-down means 116 that discharges gases from the vacuum chamber 102 to reduce the pressure (e.g., to make the vacuum) in the inside thereof (inside the film deposition system).

Sites in the vacuum chamber 102 where plasma develops or an arc is produced by plasma generating electromagnetic waves may be covered as required with an insulating member such as MC nylon, Teflon (PTFE) or the like.

The gas introducing section 104 includes two gas introducing pipes 104*a* and a gas introducing pipe 104*b*. As an exemplary example, the gas introducing pipes 104*a* introduces a plasma generating gas, while the gas introducing pipe 104*b* introduces a reactive gas for use in the plasma-assisted CVD.

Examples of the plasma generating gas are inert gases such as helium, neon and the like. Examples of the reactive gas for producing the carbon protective layer 92 are gases of hydrocarbon compounds such as methane, ethane, propane, ethylene, acetylene, benzene and the like. Examples of the reactive gas for producing the intermediate layer 90 are various gases including materials used for forming the intermediate layer 90.

To effect sputtering, a target to be sputtered is placed on a cathode which is rendered at negative potential and a plasma is generated on the surface of the target, whereby atoms are struck out of the target to attach to the surface of the opposed substrate and deposit thereon allowing the film to be formed.

The first sputter means 106 and the second sputter means 108 are intended for sputtering film deposition on the surface of the substrate. The former comprises a cathode 118, an area where the target 120 is to be placed, a shutter 122, a direct current (DC) power supply 124 and other components. The latter comprises a cathode 126, an area where the target 120 is to be placed, a shutter 128, a direct current (DC) power supply 130 and other components.

As seen from the above configuration, the first sputter means 106 and the second sputter means 108 have basically a similar configuration except that positions of the respective components are different. Therefore, the first sputter means is now described as a typical example.

In order to generate a plasma on the surface of the target 120, the negative side of the DC power supply 124 (130) is directly connected to the cathode 118 (126), which is supplied with a DC voltage of 300V to 1,000 V. An output of the DC power supply 124 may appropriately be selected so as to be necessary and sufficient for producing a desired film.

In the illustrated example, a backing plate 132 (134) made of oxygen-free copper, stainless steel or the like is fixed to the cathode 118 and the target 120 is then fixed thereon by an In-based solder or a mechanical fixing means. Examples of preferred materials of the target 120 used to form the intermediate layer 90 include metals of Groups IVA, VA and VIA and monocrystalline Ge and Si and the like. As an exemplary illustration, the target 120 used to form the carbon protective layer 92 is preferably made of sintered carbon, glassy carbon or the like.

The illustrated apparatus performs magnetron sputtering, in which magnets 118*a* (126*a*) are placed within the cathode 118. The magnetron sputtering confines plasma within a magnetic field formed on the surface of the target 120. Magnetron sputtering is preferred since it achieves high deposition rates.

The illustrated film deposition apparatus 100 performs film depositions such as the carbon protective layer 92 and the like using the plasma-assisted CVD that utilizes microwave ECR discharge in which the plasma is generated by a microwave and a ECR magnetic field. The plasma generating means 110 comprises a microwave source 136, magnets 138, a microwave guide 140, a coaxial transformer 142, a dielectric plate 144 and a radial antenna 146 and the like.

The microwave source 136 may appropriately be selected from those in commercial use which produce outputs necessary and sufficient to produce the carbon protective layer 92 or the like.

As magnets 138 for generating the ECR magnetic field, permanent magnets or electromagnets which are capable of forming the desired magnetic field may appropriately be employed.

Microwaves are introduced into the vacuum chamber 102 using the microwave guide 140, the coaxial transformer 142, the dielectric plate 144 and the like.

The substrate holder 114 is used to fix in position a material (film deposition substrate) on which a film is deposited such as the thermal head (glaze) 66 or the like.

The film deposition apparatus 100 as shown in FIG. 3 comprises three film deposition means. The substrate holder 114 is held on the rotary base 150 which rotates to move the substrate holder 114 so that the glaze on the substrate can be opposed to the respective film deposition means, that is, the sputter means 106 and 108, and the plasma generating means 110 by means of the plasma-assisted CVD.

The distance between the substrate and target 120 or the radial antenna 146 is not limited to any particular value and a distance that provides a uniform thickness profile may be set appropriately.

As described above, the surfaces of the lower protective layer 88 and the intermediate layer 90 are optionally etched to provide a rough surface. Film deposition is preferably performed with a negative bias voltage being applied to the substrate in order to obtain a hard film by the plasma-assisted CVD.

To do this, the bias source 112 which applies a radio-frequency voltage is connected to the substrate holder 114 in the film deposition apparatus 100.

The radio-frequency self-bias voltage is preferably used in the plasma-assisted CVD.

In a preferred embodiment, the film deposition apparatus 100 as shown in FIG. 3 comprises these three film deposition means: the sputter means 106 and 108, and the plasma generating means 110 used for plasma-assisted CVD. However, the thermal head 66 of the invention is not limited to forming the carbon protective layer 92 and the like using this film deposition apparatus 100 and a conventional film deposition apparatus having one sputter means or one plasma generating means may of course be used. In addition, various film deposition apparatus of different configuration are available in accordance with the intended layer-structure of the thermal head, as exemplified by a film deposition apparatus which comprises one sputter means and one plasma generating means, and a film deposition apparatus which comprises two or three sputter means or plasma generating means.

On the foregoing pages, the thermal head of the invention has been described in detail but the present invention is in no way limited to the stated embodiments and various improvements and modifications can of course be made without departing from the spirit and scope of the invention.

EXAMPLES

The invention will further be illustrated by means of the following specific examples.

Example 1

A commercial thermal head (Model KGT-260-12MPH8 of KYOCERA CORP.) was used as the base. The thermal head has a silicon nitride ($Si_3N_4$) film deposited in a thickness of 11 $\mu$m as a protective film on the surface of the glaze. Therefore, in Example 1, the silicon nitride film serves as the lower protective layer 88 on which the intermediate layer 90 is formed. The carbon protective layer 92 is then formed on the intermediate layer 90.

The film deposition apparatus 100 as shown in FIG. 3 was used to form the intermediate layer 90 and the carbon protective layer 92 on the base thermal head as described above. The film deposition apparatus 100 is further described below.

a. Vacuum Chamber 102

The vacuum chamber 102 made of SUS 304 and having a capacity of 0.5 m3 and a vacuum pump-down means was used, in which the vacuum pump-down means 116 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 104

A mass flow controller permitting a maximum flow rate of 100 to 500 sccm and a stainless steel pipe having a diameter of 6 mm were used to form two gas introducing pipes 104*a* and 104*b*, the former being used for introducing a plasma generating gas and the latter being used for introducing a reactive gas.

c. First Sputter Means 106 and Second Sputter Means 108

The cathodes 118 and 126 used were in a rectangular form having a width of 600 mm and a height of 200 mm, with Sm—Co magnets being incorporated as the permanent magnets 118*a* and 126*a*. Rectangular oxygen-free copper members were attached to the cathodes 118 and 126 with In-based solder as the backing plates 132 and 134. The interior of the cathodes 118 and 126 was water-cooled to cool the magnets 118*a* and 126*a*, the cathodes 118 and 126 and the rear side of each of the backing plates 132 and 134.

The DC power supplies 124 and 130 used was at negative potential capable of producing a maximal output of 8 kW. These DC power supplies were adapted to be capable of pulse modulation at frequencies in the range of 2 to 10 kHz.

d. Plasma Generating Means 110

The microwave source 136 oscillating at a frequency of 2.45 GHz and producing a maximal output of 1.5 kW was employed. The generated microwave was guided to the neighborhood of the vacuum chamber 102 by means of the microwave guide 140, converted in the coaxial transformer 142 and directed to the radial antenna 146 in the vacuum chamber 102.

The plasma generating part used was in a rectangular form having a width of 600 mm and a height of 200 mm.

A magnetic field for ECR was produced by arranging a plurality of Sm—Co magnets used as the magnets 138 in a pattern to conform to the shape of the dielectric plate 144.

e. Substrate Holder 114

The rotary base 150 was rotated to move the substrate holder 114 so that the substrate (that is, the glaze of the thermal head 66) fixed thereon is kept opposed to one of the targets 120 in the first and second sputter means 106 and 108 and the radial antenna 146 in the plasma generating means 110.

The distance between the substrate and each target 120 or the radial antenna 146 can be adjusted in the range of from 50 to 150 mm irrespective of the direction in which the substrate faces. The distance between the substrate and each target 120 was set to 100 mm when sputtering was used to form the intermediate layer 90 and the carbon protective layer 92 as described below.

In addition, the area of the substrate in which the thermal head was held was set at a floating potential in order to enable the application of an etching radio-frequency voltage. A heater was also provided on the surface of the substrate holder 114 for film deposition with heating.

f. Bias Source 112

An RF power supply was connected to the substrate holder 114 via the matching box.

The RF power supply had a frequency of 13.56 MHz and could produce a maximal output of 3 kW. It was also adapted to be such that by monitoring the self-bias voltage, the RF output could be adjusted over a range of −100 to −500 V.

In this apparatus 100, the bias source 112 also serves as the substrate etching means.

Fabrication of Thermal Head:

In the film deposition apparatus 100, the thermal head 66 was secured to the substrate holder 114 in the vacuum chamber 102 such that the glaze 66 of the thermal head would be kept opposed to the position where the target 120 of the first sputter means 106 was arranged. After the thermal head was fixed in position, the vacuum chamber 102 was pumped down to an internal pressure of $5\times10^{-6}$ Torr. All areas of the thermal head other than those where the intermediate layer 90 was to be formed were previously masked.

With continued pump-down, argon gas was introduced through the gas introducing section 104 and the pressure in the vacuum chamber 102 was adjusted to $5.0\times10^{-3}$ Torr by means of the orifice valve fitted on the turbomolecular pump. Subsequently, a radio-frequency voltage was applied to the substrate and the lower protective layer (silicon nitride film) was etched for 10 minutes at a self-bias voltage of −300 V.

After the end of etching, a monocrystalline silicon and a sintered graphite member were fixed (i.e., attached by means of In-based solder) on the backing plate 132 in the first sputter means 106 and on the backing plate 134 in the second sputter means 108, respectively. Then, the vacuum chamber 102 was evacuated and the argon gas flow rate and the orifice valve were adjusted so as to maintain the internal pressure in the vacuum chamber 102 at $5.0\times10^{-3}$ Torr, whereupon a DC power of 0.5 kW was applied to the target 120 for 5 minutes, with the shutter 122 being closed.

Subsequently, with the internal pressure in the vacuum chamber 102 kept at the stated level, the DC power was raised to 5 kW and then the shutter 122 was opened. The sputtering was performed until the intermediate layer 90 has a thickness of 0.2 μm. Thus, a silicon layer with a thickness of 0.2 μm was formed as the intermediate layer 90. To control the thickness of the silicon layer to be formed, the deposition rate was determined previously and the time required to reach a specified film thickness was calculated.

After the intermediate layer is formed, the rotary base 150 was rotated to oppose the glaze to the target 120 (i.e. the sintered graphite member) of the second sputter means 108 without releasing the inside of the vacuum chamber 102 to the atomosphere. The argon gas flow rate and the orifice valve were adjusted so as to maintain the internal pressure in the vacuum chamber 102 at $5.0\times10^{-3}$ Torr, and a DC power of 0.5 kW was applied to the target 120 for 5 minutes with the shutter 128 being closed.

Subsequently, with the internal pressure in the vacuum chamber 102 kept at the stated level, the DC power was raised to 5 kW and the shutter 128 was opened. The sputtering was performed until the carbon protective layer 92 has a thickness of 2 μm to fabricate a thermal head. To control the thickness of the carbon protective layer 92 to be formed, the deposition rate was determined previously and the time required to reach a specified film thickness was calculated.

A portion (a location irrelevant to thermal recording) of the three-layered protective film formed on the thus fabricated thermal head was rendered to be a sample. After the sample was subjected to thin film forming processing, an interface between the intermediate layer 90 and the carbon layer 92 of the sample was analyzed using a KEVEX DELTA plus quantitative total system energy-dispersive X-ray analysis (Si <Li>semiconductor detector UTW type).

As the result, the oxygen amount in the interface where the intermediate layer 90 and the carbon layer 92 face to each other was 15 atm %.

Evaluation of Performance:

The thus fabricated thermal head 66 was incorporated into the thermal recording apparatus 10 shown in FIG. 1 and thermal recording test was performed using a thermal material of B4 size (dry image recording film CR-AT of Fuji Photo Film Co., Ltd.).

The surface of the glaze of the thermal head 66 was evaluated after thermal recording was performed on 25000 sheets of the thermal material. The result was that neither crack nor peel-off was found on the protective film.

Example 2

The procedure of Example 1 was repeated to fabricate another sample of the thermal head 66 with a three-layered protective film except that, after an Si film was formed, process was interrupted until the pressure inside the system comes down to below the initial evacuation (pump-down) pressure. When the interface between the intermediate layer 90 and the carbon layer 92 of the obtained protective film was analyzed in the same manner as in Example 1, the oxygen amount in the interface was 10 atm %.

Using the thus fabricated thermal head 66, thermal recording was performed on 25000 sheets of the thermal material in the same manner as in Example 1. When the surface of the glaze of the thermal head 66 was checked, neither crack nor peel-off was found on the protective film.

Comparative Example 1

The procedure of Example 1 was repeated to fabricate another sample of the thermal head with a three-layered protective film except that the initial evacuation time was shortened allowing the process to start at $2.0\times10^{-5}$ Torr. When the interface between the intermediate layer 90 and the carbon layer 92 of the obtained protective film was analyzed in the same manner as in Example 1, the oxygen amount in the interface was 25 atm %.

Using the thus fabricated thermal head 66, thermal recording was performed on 12000 sheets of the thermal material in the same manner as in Example 1, so that a change of image quality is generated. When the surface of the glaze of the used thermal head 66 was checked, peel-off was noticed on the protective film.

Comparative Example 2

The procedure of Example 1 was repeated to fabricate another sample of the thermal head with a three-layered protective film except that, after the intermediate layer 90 (silicon layer) is formed, the interior of the vacuum chamber 102 was released up to the normal pressure. When the interface between the intermediate layer 90 and the carbon layer 92 of the obtained protective film was analyzed in the same manner as in Example 1, the oxygen amount in the interface was 30 atm %.

Using the thus fabricated thermal head 66, thermal recording was performed on 8000 sheets of the thermal material in the same manner as in Example 1, so that a change of image quality is generated. When the surface of the glaze of the used thermal head 66 was checked, peel-off was noticed on the protective film.

These results clearly demonstrate the effectiveness of the thermal head of the present invention.

As described above in detail, the present invention provides a thermal head having a protective film which has significantly reduced corrosion and wear, which is free from cracking and peeling due to heat and mechanical impact and which allows the thermal head to have sufficient durability to ensure that the thermal recording of high-quality images is consistently performed over an extended period of time. Even for an application in which recording under high-energy and high-pressure conditions is performed on a thermal film using a high rigid substrate employed in the aforementioned medical use and the like, the thermal head also has sufficient durability to exhibit high reliability over an extended period of time.

What is claimed is:

1. A thermal head having a protective film of a heating element, said protective film comprising at least one protective layer including a carbon protective layer with carbon as a main component, wherein an oxygen amount in an interface between said carbon protective layer and a lower layer formed under said carbon protective layer is not more than 20 atm %.

2. The thermal head according to claim 1, wherein said at least one protective film further comprises an intermediate protective layer formed as said lower layer under said carbon protective layer and a ceramic-based lower protective layer formed under said intermediate protective layer.

3. The thermal head according to claim 2, wherein said intermediate protective layer is based on at least one component selected from the group consisting of metals of Groups IVA, VA and VIA, and Si and Ge.

4. The thermal head according to claim 1, wherein said at least one protective layer further comprises a ceramic-based lower protective layer formed as said lower layer under said carbon protective layer.

5. The thermal head according to claim 1, wherein said oxygen in the interface is not more than 10 atm %.

* * * * *